US009366005B2

(12) United States Patent
Hiragakiuchi et al.

(10) Patent No.: US 9,366,005 B2
(45) Date of Patent: Jun. 14, 2016

(54) SWING BRACKET OF CONSTRUCTION MACHINE

(71) Applicant: KOBELCO CONSTRUCTION MACHINERY CO., LTD., Hiroshima-shi (JP)

(72) Inventors: Atoshi Hiragakiuchi, Hiroshima (JP); Mitsuo Nakatani, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 257 days.

(21) Appl. No.: 14/211,326

(22) Filed: Mar. 14, 2014

(65) Prior Publication Data

US 2014/0301771 A1 Oct. 9, 2014

(30) Foreign Application Priority Data

Apr. 9, 2013 (JP) ..... 2013-081110

(51) Int. Cl.
*E02F 3/36* (2006.01)
*E02F 3/38* (2006.01)
*E02F 3/627* (2006.01)

(52) U.S. Cl.
CPC ..... *E02F 3/384* (2013.01); *E02F 3/627* (2013.01); *Y10T 403/32606* (2015.01)

(58) Field of Classification Search
CPC ..... E02F 3/384; E02F 3/627; E02F 3/382; E02F 3/386; E02F 3/369; Y10T 403/32; Y10T 403/32008; Y10T 403/32106; Y10T 403/32188; Y10T 403/32221; Y10T 403/32606; Y10T 403/34; Y10T 403/341; Y10T 403/73; Y10T 403/77; Y10T 16/5472; Y10T 16/5478; Y10T 16/551; Y10T 16/558; Y10T 16/559; F16C 11/04; F16C 11/00
USPC ..... 248/200, 205.1, 218.4; 414/686
See application file for complete search history.

(56) References Cited

U.S. PATENT DOCUMENTS 3,872,985 A * 3/1975 Short ..... E02F 3/384 414/694
3,916,477 A * 11/1975 Baker, Sr. ..... A47H 1/144 16/94 D (Continued)

FOREIGN PATENT DOCUMENTS

JP 9-209385 A 8/1997
JP 2003-176548 6/2003

(Continued)

OTHER PUBLICATIONS

Extended European Search Report issued Sep. 16, 2014, in European Patent Application No. 14161023.8.

(Continued)

*Primary Examiner* — Joshua J Michener
*Assistant Examiner* — Kyle Walraed-Sullivan
(74) *Attorney, Agent, or Firm* — Oblon, McClelland, Maier & Neustadt, L.L.P

(57) ABSTRACT

Provided is a sufficiently reinforced swing bracket of a construction machine. The swing bracket includes a bracket body, a main connection portion connected to an upper slewing body of the construction machine, a swing-cylinder connection portion being protruded from one of right and left side parts of a lower end region of the bracket body to be connected to an end part of the swing cylinder and having a pair of supporting arms vertically opposed to each other with an interval, and a reinforcement portion for reinforcing a basal part of the swing-cylinder connection portion. The reinforcement portion has a main rib briding the supporting arms, and upper, lower, front, and rear ribs each extending from the main rib to an opposite side from the swing-cylinder connection portion. The upper and lower ribs and the front and rear ribs are continuous to form a box-shaped body.

2 Claims, 7 Drawing Sheets

(56) References Cited

U.S. PATENT DOCUMENTS 3,929,239 A * 12/1975 Shumaker ..... E02F 3/386 212/245
4,221,531 A * 9/1980 Baron ..... E02F 3/302 414/694
4,523,397 A * 6/1985 Lucas ..... E02F 3/401 37/444
4,546,996 A * 10/1985 Hanson ..... B66C 23/80 182/109
4,720,234 A * 1/1988 Stralow ..... E02F 3/30 172/272
4,921,392 A * 5/1990 Wagner ..... E02F 9/085 212/304
5,577,695 A * 11/1996 Ruckwardt ..... B60Q 5/00 248/200
D458,942 S * 6/2002 Balemi ..... D15/28
6,547,478 B1 * 4/2003 Lin ..... A47B 96/061 248/200
6,718,663 B1 * 4/2004 Geraghty ..... E02F 3/3618 37/443
D593,849 S * 6/2009 Balemi ..... D15/28
D638,039 S * 5/2011 Miller ..... D15/28
D638,448 S * 5/2011 Miller ..... D15/28
8,113,472 B2 * 2/2012 Wippler ..... H05K 5/0204 248/200
D686,642 S * 7/2013 Urase ..... D15/28
2002/0174573 A1 * 11/2002 Ichikawa ..... E02F 3/32 37/348
2004/0187366 A1 * 9/2004 Yoshida ..... E02F 3/384 37/407
2005/0047899 A1 * 3/2005 Sugimoto ..... E02F 3/325 414/724
2006/0243870 A1 * 11/2006 Ishiguro ..... H05K 5/0204 248/200
2006/0254415 A1 * 11/2006 Miyazaki ..... E02F 3/384 91/508
2007/0068048 A1 * 3/2007 Ishihama ..... E02F 3/815 37/231
2007/0068722 A1 * 3/2007 Miyake ..... E02F 9/0808 180/327
2007/0134081 A1 * 6/2007 Seabolt ..... E02F 3/08 414/723
2008/0083144 A1 * 4/2008 Sederberg ..... E02F 3/3604 37/468
2008/0170933 A1 * 7/2008 Nishioka ..... E02F 3/3618 414/723
2009/0107015 A1 * 4/2009 Sakada ..... E02F 3/388 37/440
2009/0134109 A1 * 5/2009 Shimoie ..... E02F 3/301 212/347
2009/0211833 A1 * 8/2009 Lee ..... E02F 9/0816 180/311
2010/0300778 A1 * 12/2010 Miyazaki ..... B62D 49/065 180/53.3
2012/0230804 A1 * 9/2012 Tan ..... E02F 9/2271 414/686
2014/0205411 A1 * 7/2014 Zheng ..... E02F 9/0816 414/687
2014/0301771 A1 * 10/2014 Hiragakiuchi ..... E02F 3/627 403/119
2015/0003949 A1 * 1/2015 Kusama ..... E02F 9/2275 414/722
2015/0197918 A1 * 7/2015 Feng ..... E02F 9/006 403/161

FOREIGN PATENT DOCUMENTS

JP 2004-68290 3/2004
JP 2005-76314 A 3/2005
JP 2005-113528 A 4/2005
JP 2005-232712 A 9/2005

OTHER PUBLICATIONS

Office Action issued Feb. 10, 2015 in Japanese Patent Application No. 2013-081110 (with English language summary).

* cited by examiner

SWING BRACKET OF CONSTRUCTION MACHINE

BACKGROUND OF THE INVENTION

1. Field of the Invention

The present invention relates to a swing bracket which swings a boom and the like right and left while supporting the boom in a construction machine such as an excavator.

2. Description of the Related Art

A background technique of the present invention is described by taking an excavator shown in FIG. 6 as an example.

The excavator includes: a crawler-system lower traveling body 1; an upper slewing body 2 slewably mounted on the crawler-system lower traveling body 1 around an axis O perpendicular to a ground surface; a working attachment 9 attached to the upper slewing body 2 and including a boom 3, an arm 4, a bucket 5, a plurality of hydraulic cylinders, namely, a boom cylinder 6, an arm cylinder 7 and a bucket cylinder 8 which move the boom 3, the arm 4 and the bucket 5, respectively; an operating seat 10 provided on the upper slewing body 2; and a canopy 11 which covers over the operating seat 10. In the present specification, "front and rear" and "right and left" refer to directionality from the viewpoint of an operator seated on the operating seat 10.

The excavator is a swing-type, further including a swing bracket 12 and a swing cylinder 16. The swing bracket 12 is attached to a front part of the upper slewing body 2 so as to be capable of being turned to swung right and left around swing pins 13 as a vertical axis. A base end part of the boom 3, namely, a boom foot, is attached to the swing bracket 12 via a boom foot pin 14, and one end of the boom cylinder 6 is attached to the swing bracket 12 via a boom cylinder pin 15 turnably around a horizontal axis in a right-and-left direction. The swing cylinder 16 turns the swing bracket 12 so as to swing it. The swing cylinder 16 is attached to the swing bracket 12 via a swing cylinder pin 17, turnably around a vertical axis. The whole of the attachment 9 including the boom 3 is thus allowed to be raised and lowered around the boom foot pin 14 and to be swung right and left around the swing pins 13.

The above configurations are disclosed in Japanese Patent Application Laid-open No. 2003-176548 and Japanese Patent Application Laid-open No. 2004-68290.

FIG. 7 to FIG. 10 show a configuration of a conventional swing bracket 12. The swing bracket 12 is formed by molding to have a boom-foot connection portion 18 to which the boom foot is connected, a boom-cylinder connection portion 19 to which the boom cylinder 6 is connected, a swing-cylinder connection portion 20 to which the swing cylinder 16 is connected, and a bracket body 21. The boom-foot connection portion 18, the boom-cylinder connection portion 19, and the swing-cylinder connection portion 20 form an upper end portion, a front portion of a vertically intermediate region, and a lower-end right-side portion of the swing bracket 12, respectively. The bracket body 21 is a portion other than the connection portions 18 to 20, interconnecting adjacent connection portions.

The boom-foot connection portion 18 has a pair of supporting arms 18*a* and 18*b* laterally opposed to each other with an interval. The boom-cylinder connection portion 19 has a pair of supporting arms 19*a* and 19*b* laterally opposed to each other with an interval. The swing-cylinder connection portion 20 has a pair of supporting arms 20*a* and 20*b* vertically opposed to each other with an interval. Each of the supporting arms 18*a*, 18*b*, 19*a*, 19*b*, 20*a*, and 20*b* has a pin hole 22 to which a pin corresponding to the supporting arms is inserted; the pin is the boom foot pin 14, the boom cylinder pin 15, or the swing cylinder pin 17 shown in FIG. 6.

The excavator further includes a swing-bracket attachment portion 23 shown in FIG. 8, to which the swing bracket 12 is attached. The swing-bracket attachment portion 23 protrudes forward from a front end of the upper slewing body 2. The swing-bracket attachment portion 23 has a pair of supporting parts 23*a* which are located at a front end of the swing-bracket attachment portion 23 and vertically opposed to each other.

On the other hand, the swing bracket 12 has a main connection portion 24 shown in FIG. 8 and FIG. 10. The main connection portion 24 is to be connected to the swing-bracket attachment portion 23, having a pair of upper and lower parts 24*a*. The supported parts 24*a* have respective swing pin holes 25. The swing pin 13 shown in FIG. 6 is inserted through the swing pin holes 25 and the pin holes of the supporting parts 23*a*. The supported parts 24*a* are thereby coupled to the supporting parts 23*a*.

The swing bracket 12 has a reinforcement structure for particularly reinforcing the swing-cylinder connection portion 20 and peripheral parts thereof. This structure includes a vertical rib 26 shown in FIG. 9. The vertical rib 26 has substantially a triangular shape to interconnect an upper surface of the upper-side supporting arm 20*a* at a basal portion of the swing-cylinder connection portion 20 and a right side surface of the body 21 adjacent to the upper surface, across over the upper surface of the upper-side supporting arm 20*a* and the right side surface of the body 21.

However, a specific portion of the vertical rib 26, the portion being surrounded by a circle shown by broken lines in FIG. 9, that is, a terminal connected to the upper-side supporting arm 20*a* and the right side surface of the body 21, can have stress concentration, which may cause destruction at the portion. Besides, the reinforcement by the vertical rib 26 is not sufficiently effective in the lower supporting arm 20*b*, which may allow the lower supporting arm 20*b* to be destructed.

As means for avoiding the destruction, there may be one way to increase a thickness of a portion across over both-side supporting arms 20*a* and 20*b* out of the basal part of the swing-cylinder connection portion 20 (an ellipse portion shown by shaded lines in FIG. 9, for example) to thereby increase the reinforcement effect while avoiding the above stress concentration. The increase in the thickness, however, involves a significant weight increase, that is, an increase of a few kilograms depending on a case, thus generating difficulty in handling the swing bracket 12 and increasing cost.

Furthermore, decreasing outward protrusion of the both-side supporting arms 20*a* and 20*b* to reduce a load applied to the basal portion extremely constrains a right-and-left movement of the swing cylinder 16 shown in FIG. 6 and FIG. 8.

SUMMARY OF THE INVENTION

An object of the present invention is to provide a sufficiently reinforced swing bracket of a construction machine.

Provided by he present invention is a swing bracket to be provided in a construction machine equipped with a lower traveling body and an upper slewing body slewably mounted on the lower traveling body, so as to be turned in a right-and-left direction around a vertical axis by a swing cylinder. The swing bracket includes: a bracket body; a main connection portion joined to the bracket body and adapted to be connected to the upper slewing body so as to be allowed to be turned in a right-and-left direction around a vertical axis; a swing-cylinder connection portion protruded from one of right and left side parts of a lower end part of the bracket body and adapted to be connected to an end part of the swing cylinder, the swing-cylinder connection portion having a pair of supporting arms vertically opposed to each other with an interval; and a reinforcement portion for reinforcing a basal part of the swing-cylinder connection portion. The reinforcement portion includes a main rib bridging the pair of supporting arms and a plurality of ribs including an upper rib, a lower rib, a front rib, and a rear rib which ribs extend from an upper end, a lower end, a front end, and a rear end of the main rib, respectively, to an opposite side from the swing-cylinder connection portion. The pair of the upper and lower ribs and the pair of the front and rear ribs are continuous with each other to integrally form a box-shaped body opened to the opposite side of the main rib from the swing-cylinder connection portion.

DESCRIPTION OF THE PREFERRED EMBODIMENT

Figure 1:
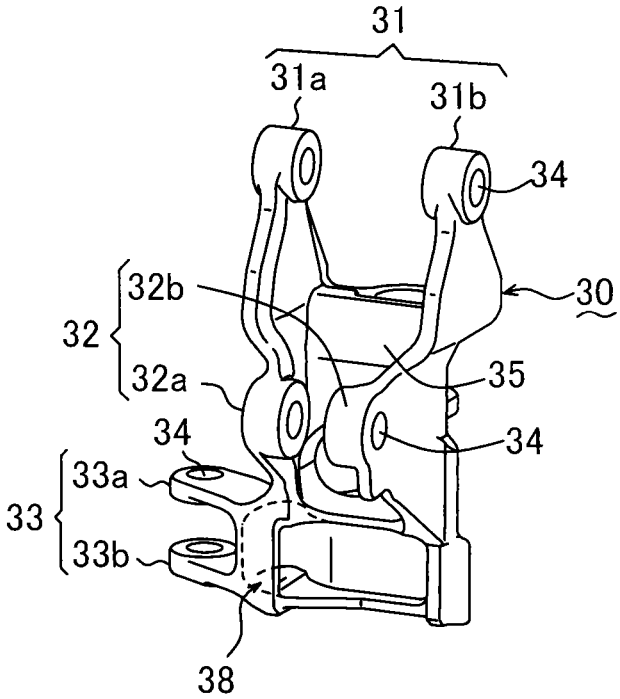
FIG. 1 is a perspective view of a swing bracket according to an embodiment of the present invention.

An embodiment according to the present invention is described below with reference to FIG. 1 to FIG. 5.

FIG. 1 to FIG. 5 show a swing bracket 30 according to the present embodiment. The swing bracket 30 is formed by molding to include a bracket body 35, a boom-foot connection portion 31, a boom-cylinder connection portion 32, a swing-cylinder connection portion 33, a main connection portion 36, and a reinforcement portion 38, all of which are formed integrally.

The boom-foot connection portion 31 forms an upper end part of the swing bracket 30. The boom-cylinder connection portion 32 forms a front side part of a vertically intermediate region of the swing bracket 30. The swing-cylinder connection portion 33 forms a right side part of a lower end region of the swing bracket 30.

Figure 6:
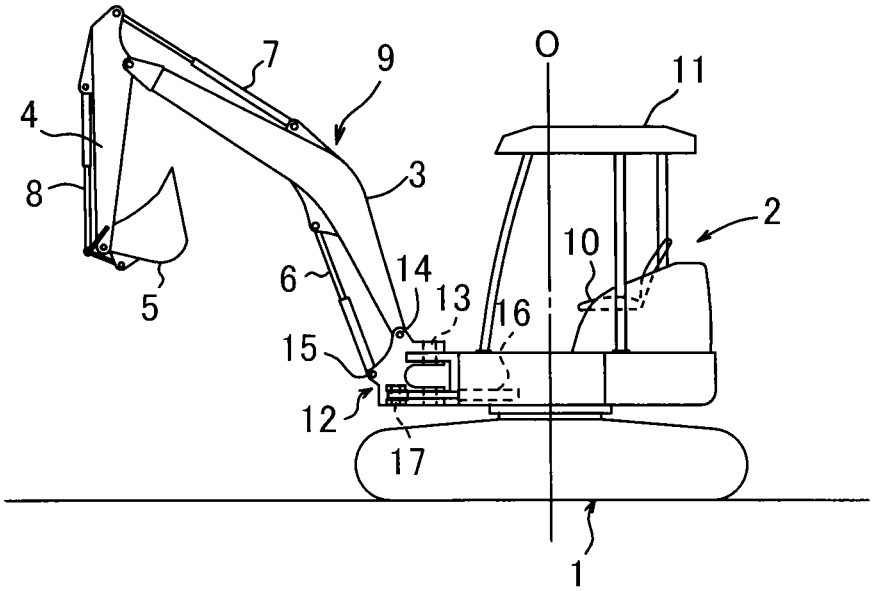
FIG. 6 is a schematic side view of a swing-type excavator.
Figure 7:
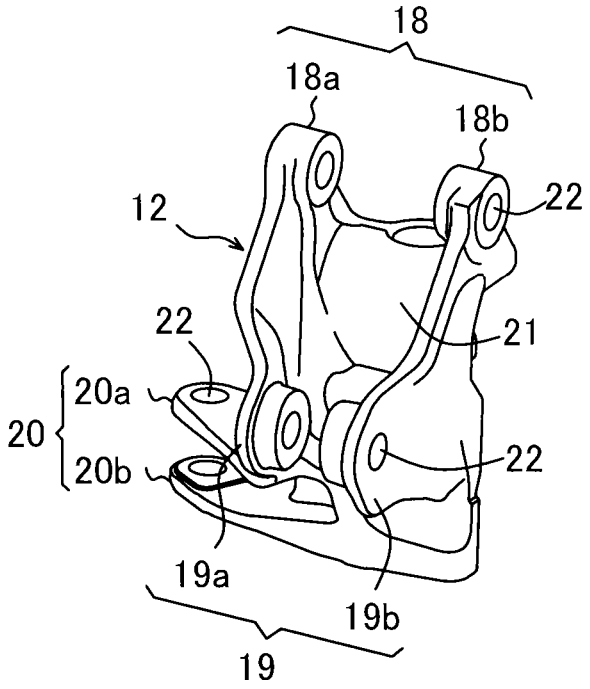
FIG.7 PRIOR ART
FIG. 7 is a perspective view of a conventional swing bracket.
Figure 8:
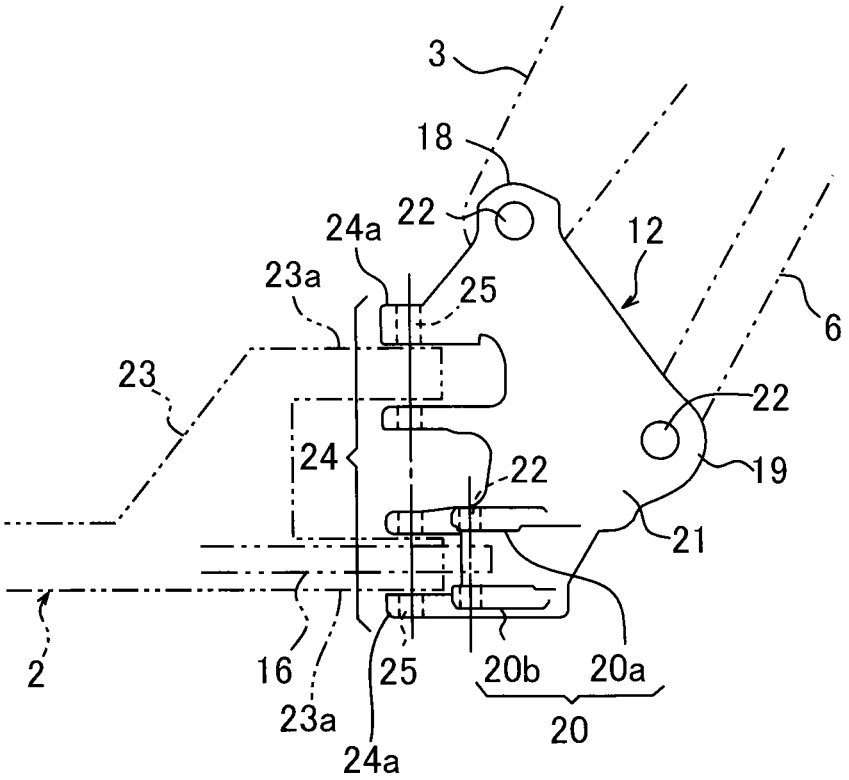
FIG.8 PRIOR ART
FIG. 8 is a right side view of the swing bracket shown in FIG. 7.

The boom-foot connection portion 31 has a pair of supporting arms 31*a* and 31*b*, which are laterally opposed to each other with an interval. The boom-cylinder connection portion 32 has a pair of supporting arms 32*a* and 32*b*, which are laterally opposed to each other with an interval. The swing-cylinder connection portion 33 has a pair of supporting arms 33*a* and 33*b*, which are vertically opposed to each other with an interval. Similar to the swing bracket 12 shown in FIG. 6 to FIG. 10, the supporting arms 31*a* and 31*b* are provided with respective pin holes 34 through which a boom foot pin similar to the boom foot pin 14 shown in FIG. 6 is inserted. The supporting arms 32*a* and 32*b* are provided with respective pin holes 34 through which a boom cylinder pin similar to the boom cylinder pin 15 shown in FIG. 6 is inserted. The supporting arms 33*a* and 33*b* are provided with respective pin holes 34 through which a swing cylinder pin similar to the swing cylinder pin 17 shown in FIG. 6 is inserted.

The bracket body 35 is a portion which interconnects the connection portions 31 to 33. The swing-cylinder connection portion 33 is therefore protruded outward from a right side part as one of the right and left side parts of the lower end part of the bracket body 35.

Figure 3:
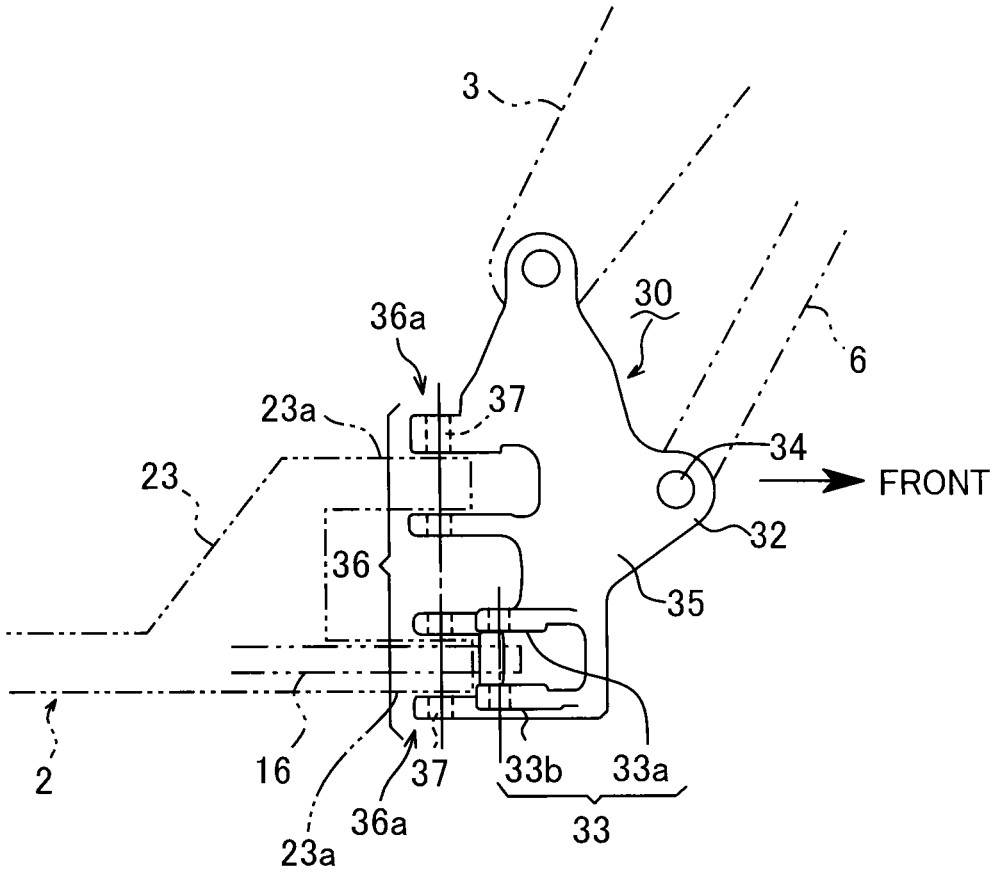
FIG. 3 is a right side view of the swing bracket.

The main connection portion 36 is connected to the swing-bracket attachment portion 23 shown in FIG. 3. The swing-bracket attachment portion 23 is provided at a front end of the upper slewing body 2, and has a pair of supporting parts 23*a* which are vertically arranged, in a similar manner to that of the swing-bracket attachment portion 23 shown in FIG. 6. On the other hand, the main connection portion 36 has a pair of supported parts 36*a* which are vertically arranged, in a similar manner to the main connection portion 24 shown in FIG. 6. The pair of supported parts 36*a* have respective swing pin holes 37, and a swing pin similar to the swing pins 13 shown in FIG. 6 is inserted through the swing pin holes 37 and the pin holes of the supporting parts 23*a*. The supported parts 36*a* are thus supported by respective supporting parts 23*a*.

The reinforcement portion 38 is a portion for reinforcing a basal part of the swing-cylinder connection portion 33. The reinforcement portion 38 includes a main rib 39, a front rib 40, a rear rib 41, an upper rib 42, and a lower rib 43.

The main rib 39 vertically bridges the supporting arms 33*a* and 33*b* of the swing-cylinder connection portion 33. Specifically, the main rib 39 is integrally joined to respective basal end parts of the supporting arms 33*a* and 33*b* so as to vertically interconnect the basal end parts. The main rib 39 according to the present embodiment has a plate shape having a thickness direction parallel to respective directions in which the supporting arms 33*a* and 33*b* are protruded.

Figure 2:
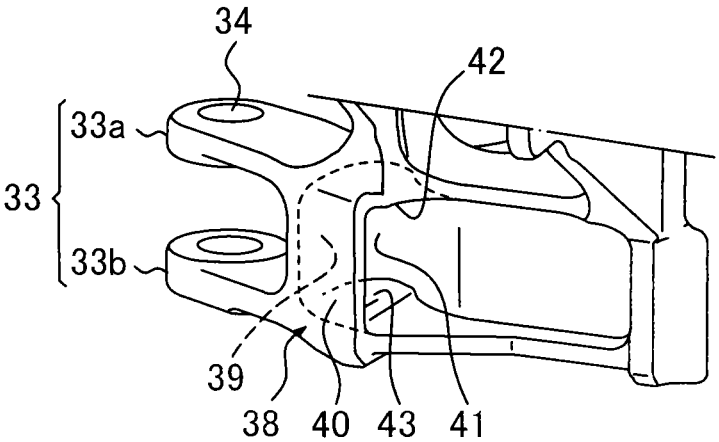
FIG. 2 is an enlarged perspective view of a part of the swing bracket in FIG. 1.

The front rib 40, the rear rib 41, the upper rib 42 and the lower rib 43 extend from an upper end, a lower end, a front end, and a rear end of the main rib 39, respectively, to an opposite side from the swing-cylinder connection portion 33, that is, to the right side in FIG. 1 and FIG. 2. The pair of right and left end parts of the upper and lower ribs 42 and 43 and the pair of upper and lower end parts of the front and rear ribs are integrally continuous with each other, thereby forming a box-shaped body opened toward the opposite side of the main rib 39 from the swing-cylinder connection portion 33, that is, toward the right side in FIG. 1 and FIG. 2. In summary, the ribs 39 to 43 are formed in a box shape which is opened in a direction opposite to the direction in which the swing-cylinder connection portion 33 is protruded, while the main rib 39 serves as a depth wall. In other words, the reinforcement portion 38 has a box-shaped structure, and the pair of supporting arms 33*a* and 33*b* are protruded outward of the main rib 39 to thereby forming the swing-cylinder connection portion 33.

Either of the specific cross-sectional shape and size of the reinforcement portion 38 can be selected variously. For example, the shape of the horizontal cross section of the reinforcement portion 38 may be, other than the substantially square shape shown in FIG. 5, such a shape that the main rib 39 serving the depth wall has a semicircular shape. Alternatively, at least one of the front and rear ribs 40 and 41 and the upper and lower ribs 42 and 43 may be curved outward or inward.

Figure 4:
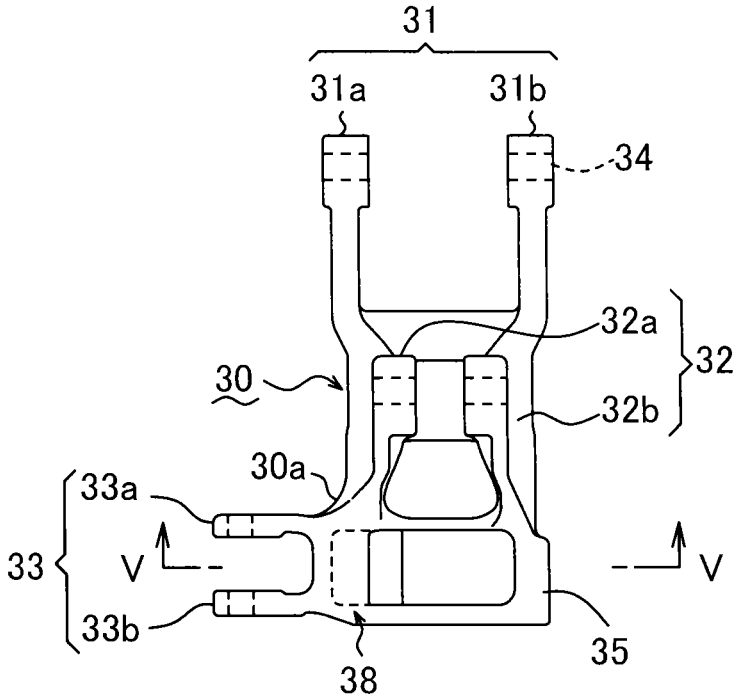
FIG. 4 is a front view of the swing bracket.
Figure 5:
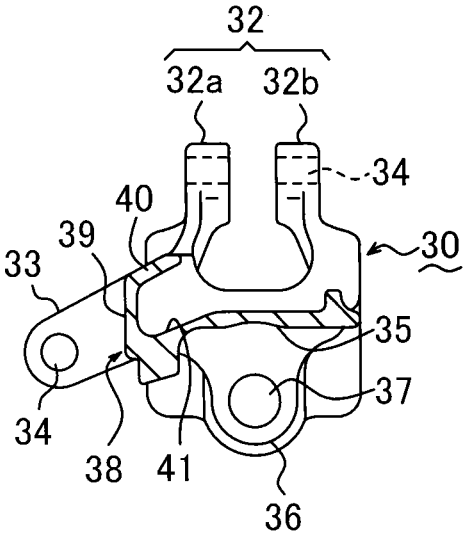
FIG. 5 is a cross-sectional view along a line V-V of FIG. 4.
Figure 9:
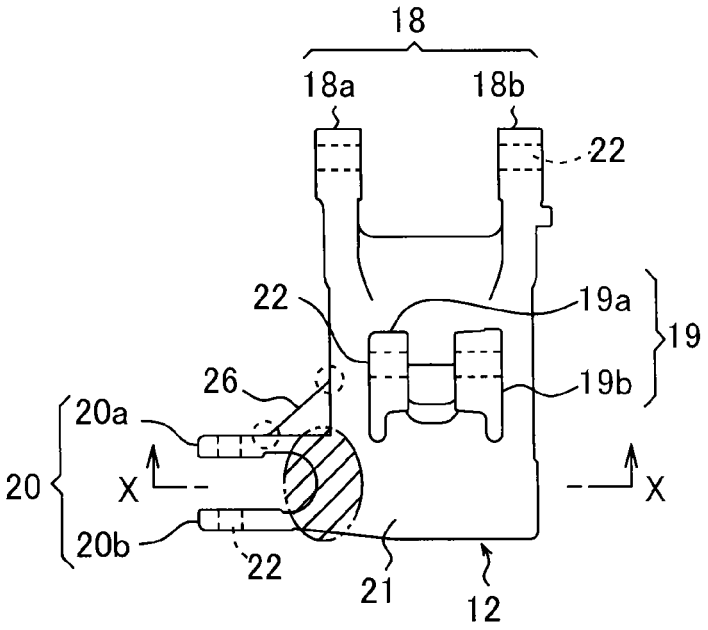
FIG.9 PRIOR ART
FIG. 9 is a front view of the swing bracket shown in FIG. 7.
Figure 10:
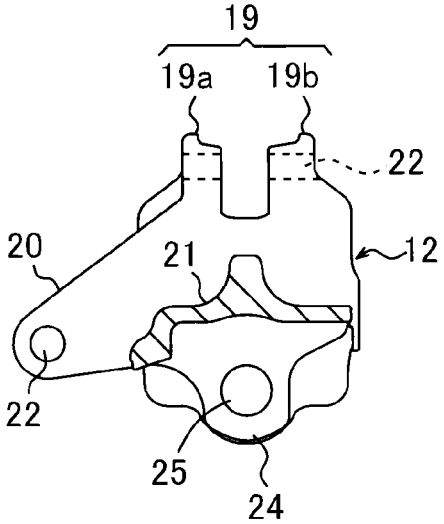
FIG.10 PRIOR ART
FIG. 10 is a cross-sectional view along a line X-X of FIG. 9.

On the other hand, the portion 30*a* continuously interconnecting the upper supporting arm 33*a* and a right-side surface part of the bracket body 35 as shown in FIG. 4, that is, the portion corresponding to the portion where the triangular vertical rib 26 is provided in the conventional swing bracket 12 shown in FIG. 9, has an outer surface curved gently enough to mitigate stress concentration at the corresponding portion 39, for example, an arc-shaped curved surface.

The reinforcement portion 38 of the box-shaped structure in the swing bracket 30 enables a high reinforcement effect particularly in the swing-cylinder connection portion 33 to be obtained, while suppressing the increase in a total weight of the swing bracket 30. Moreover, the reinforcement portion 38, having no portion where high stress concentration can occur like the terminal portion (broken-line round circled portion) of the conventional triangular rib 26 shown in FIG. 9, is hard to destruct. Besides, differently from the case of reducing the protrusion of the both-side supporting arms 33*a* and 33*b*, there is no increase in the restriction on the movement of the swing cylinder.

In addition, the reinforcement portion 38 can be simultaneously and integrally formed with other portions of the swing bracket 30, that is, the bracket body 35 and the connection portions 31 to 33 and 36, by the molding, which is useful for improving productivity and cost.

As described above, the present invention provides a sufficiently reinforced swing bracket of a construction machine. The swing bracket is to be provided in a construction machine equipped with a lower traveling body and an upper slewing body slewably mounted on the lower traveling body so as to be turned in a right-and-left direction around a vertical axis by a swing cylinder. The swing bracket includes: a bracket body; a main connection portion joined to the bracket body and adapted to be connected to the upper slewing body so as to be allowed to be turned in a right-and-left direction around a vertical axis; a swing-cylinder connection portion protruded from one of right and left side parts of a lower end part of the bracket body and adapted to be connected to an end part of the swing cylinder, the swing-cylinder connection portion having a pair of supporting arms vertically opposed to each other with an interval; and a reinforcement portion for reinforcing a basal part of the swing-cylinder connection portion. The reinforcement portion includes a main rib bridging the pair of supporting arms and a plurality of ribs including an upper rib, a lower rib, a front rib, and a rear rib which ribs extend from an upper end, a lower end, a front end, and a rear end of the main rib, respectively, to an opposite side from the swing-cylinder connection portion. The pair of the upper and lower ribs and the pair of the front and rear ribs are continuous with each other to integrally form a box-shaped body opened to the opposite side of the main rib from the swing-cylinder connection portion.

According to the swing bracket, the main rib bridging the pair of supporting arms of the swing-cylinder connection portion, and a plurality of ribs extending from the main rib to the opposite side from the swing-cylinder connection portion, namely, the front rib, the rear rib, the upper rib, and the lower rib, are continuous with each other to integrally form the box-shaped body, thereby effectively reinforcing the basal part of the swing-cylinder connection portion while involving no significant increase in the total weight of the swing bracket.

Preferably, the main rib has a plate-shape having a thickness direction which is parallel to respective directions in which the supporting arms of the swing-cylinder connection portion are protruded. The main rib enables effective reinforcement to be realized with a structure of small weight.

This application is based on Japanese Patent application No. 2013-081110 filed in Japan Patent Office on Apr. 9, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A swing bracket to be provided in a construction machine equipped with a lower traveling body and an upper slewing body slewably mounted on the lower traveling body so as to be turned in a right-and-left direction around a vertical axis by a swing cylinder, the swing bracket comprising:

a bracket body;

a main connection portion joined to the bracket body and adapted to be connected to the upper slewing body so as to be allowed to be turned in a right-and-left direction around a vertical axis;

a swing-cylinder connection portion protruded from one of right and left side parts of a lower end part of the bracket body and adapted to be connected to an end part of the swing cylinder, the swing-cylinder connection portion having a pair of supporting arms vertically opposed to each other with an interval; and a reinforcement portion for reinforcing a basal part of the swing-cylinder connection portion, the reinforcement portion including a main rib bridging the pair of supporting arms and a plurality of ribs including an upper rib, a lower rib, a front rib, and a rear rib, the upper rib, the lower rib, the front rib, and the rear rib extending from an upper end, a lower end, a front end, and a rear end of the main rib, respectively, to an opposite side from the swing-cylinder connection portion, the pair of the upper and lower ribs and the pair of the front and rear ribs being continuous with each other to integrally form a box-shaped body opened to the opposite side of the main rib from the swing-cylinder connection portion.

2. The swing bracket according to claim 1, wherein the main rib has a plate-shape having a thickness direction which is parallel to respective directions in which the supporting arms of the swing-cylinder connection portion are protruded.

* * * * *